United States Patent [19]

Frazier

[11] Patent Number: 4,779,615

[45] Date of Patent: Oct. 25, 1988

[54] TACTILE STIMULATOR

[76] Inventor: Richard K. Frazier, P.O. Box 2776, Fairbanks, Ak. 99707

[21] Appl. No.: 49,326

[22] Filed: May 13, 1987

[51] Int. Cl.[4] ..... A61H 23/00

[52] U.S. Cl. ..... 128/33; 128/54

[58] Field of Search ..... 128/33, 55, 43, 32, 128/24 R, 60

[56] References Cited

U.S. PATENT DOCUMENTS

| | | | |
|---|---|---|---|
| 2,672,860 | 3/1954 | Badger et al. | 128/33 |
| 2,821,191 | 1/1958 | Paii | 128/33 |
| 2,893,380 | 7/1959 | Wallcer et al. | 128/33 |
| 3,207,152 | 9/1985 | Thornton | 128/33 |
| 3,277,587 | 12/1963 | Holcombe | 35/5 |
| 3,298,363 | 1/1967 | Parkin | 128/33 |
| 3,309,083 | 3/1967 | George et al. | 128/33 |
| 3,483,862 | 12/1979 | Takeuchi | 128/33 |
| 3,556,088 | 1/1971 | Leonardini | 128/33 |
| 3,656,190 | 4/1972 | Regan et al. | 128/33 |
| 3,826,250 | 7/1974 | Adams | 128/33 |
| 3,831,296 | 8/1974 | Hagle | 35/35 |
| 4,023,566 | 5/1977 | Martinmaas | 128/33 |
| 4,064,376 | 12/1977 | Yamada | 128/33 |
| 4,232,661 | 11/1972 | Christensen | 128/33 |
| 4,354,067 | 10/1982 | Yamada et al. | 128/33 |
| 4,469,093 | 9/1984 | Chaplar | 128/60 |
| 4,507,816 | 4/1985 | Smith, Jr. | 5/451 |
| 4,544,867 | 10/1985 | Jones, Jr. et al. | 128/33 |

*Primary Examiner*—Paul T. Sewell
*Assistant Examiner*—Tonya Lamb
*Attorney, Agent, or Firm*—Ronald P. Kananen

[57] ABSTRACT

A tactile stimulator for causing information from a remote input source either manually or automatically to be transmitted or transposed through a converter such as a transducer or computer to an output driver to provide tactile stimulation to a user. In an preferred embodiment, a preprogrammed source of music is used to create patterns of movement and sound to create a touching and moving sensation on the body of a user to enhance the feel of the music by the user. In a manual mode, a keyboard is connected through a computer or multiplexer switching unit to permit the user to create a pattern of pleasurable or therapeutic stimulation, or to create a recorded program for later and repeated uses. In an alternative embodiment, a preprogrammed, therapeutic regime is provided to massage a user. Alternative uses of the invention are also disclosed.

19 Claims, 3 Drawing Sheets

TACTILE STIMULATOR

BACKGROUND OF THE INVENTION

This invention relates to a tactile stimulator having a variety of sources for controlling body stimulation. More particularly, this invention relates to a tactile stimulator using a plurality of body-contacting switches which are controlled electronically from a preprogrammed source, such as music or a massage prescription, for example. Still more particularly, this invention relates to a variety of physical embodiments and uses for a tactile stimulator of the type described.

A pulsating device is known to the art from U.S. Pat. No. 2,821,191 wherein pulsations from a pulsating device are synchronized with a musical score, permitting the user to "feel" the music as it is played. Such a device is said to provide a beneficial and relaxing effect of the music, and may be adapted to tone-up physically both healthy and sick persons. Such a device uses a source of musical vibrations actuating a sounding board which receives musical vibrations from a radio having a speaker. A pulsating motor cooperates with a diaphragm to increase or decrease its rotational speed to cause variable speed pulsations which are transmitted to the body of the user. A phonograph may provide an alternative source of musical selections.

Such a device has shortcomings in that the number of preprogrammed sources are limited and the mechanical actuation is somewhat cumbersome. Thus, that type of device lacks versatility in utilizing various input sources and in its effectiveness for delivering the pulses to the body of the users. In particular, the pulsations provided by that prior art device are relatively diffused to the body of the user whereas it is desirable, particularly for exercise therapy, to more specifically direct pulsations and stimulation to particular portions of the body. U.S. Pat. No. 4,507,816 is another example of a similar device wherein musical vibrations are transmitted to a body through a waterbed. Accordingly, it is an overall objective of this invention to provide a pulsating device responsive to a musical input source which is versatile, capable of using a number of input sources, and provides such pulsations in a more specifically-controlled way.

Pulsating or vibrating devices are also known as part of massage therapy, for example, as shown in U.S. Pat. No. 3,483,862. That device utilizes a hydraulically-actuated mechanism which cooperates with an armchair and bed to apply spot pressure to a number of points on the human body sitting or lying on a cushioned article. The apparatus provides an appropriate amount of external stimulus from a pressure force to various spots on a body under the control of compressed air progressively communicating with a plurality of ports. U.S. Pat. Nos. 2,672,860; 3,207,152; 3,298,363; 3,656,190; and 4,232,661 are additional examples of such limited massage devices.

Tactile stimulators are also known for communicating and teaching as is illustrated in U.S. Pat. Nos. 3,831,296 and 3,277,587. In the former patent, a plurality of stimulators are mounted in gloves linked through a communications link to a keyboard to permit correspondence between the keyboard and a stimulator. Such a device is particularly useful in communicating with the blind and deaf. The latter patent uses tactile stimulation controlled by a master keyboard to provide inputs to multiple student units to prompt correct keying during piano instruction.

It is an overall object of this invention to provide a versatile device having a plurality of stimulators linked to an input source such as music to permit the music of the artist to touch the user of the machine.

It is another object of the invention to provide a device which tactilely stimulates a user in accordance with pre-selected features of recorded music, such as amplitude, beat, frequency, or other musical parameters.

It is another object of this invention to provide a device with preprogrammed control so that an individual or an artist can provide a variety of movements and sounds to create a pleasant touch and feel.

It is another object of this invention to provide such a device which may be used in connection with preprogrammed exercise therapy to massage particular areas of the body according to a preprogrammed routine.

It is still another object of this invention to provide a device of the type described which has the potential for a number of other end uses, such as in telephone communication and safety, wherein tactile stimulation is provided for various types of communication with the user.

These and other objects of the invention will become apparent from the written description of the invention which follows, taken in conjunction with the accompanying drawings.

BRIEF DESCRIPTION OF THE DRAWINGS

Directed to achieving the foregoing objects and overcoming the shortcomings of the prior art, the method and apparatus according to the invention comprise an article structurally adapted for receiving the body of its user in a comfortable position. The article comprises a plurality of switches located in a predetermined, spaced array and which are respectively, repetitively, and sequentially actuated according to a programmed source, such as a musical source in circuit with a converter, such as a microprocessor. In one embodiment, a musical source, such as a prerecorded tape, provides a source of signals to a music analyzer which provides a preselected output for controlling the amplitude and frequency of pulsation of the switches according to the output of the decoder. Thus, switches may be actuated in accordance with the frequency, amplitude, beat, filtered frequency, or other musical characteristics derived from the input source of such musical signals according to the wishes of the programmer or the user. Such a device thus permits the user to sense physically the presence of music to enhance the sensation available from music but currently limited primarily by or to audio reaction.

In an alternative, the pulsation of the switches may be manually controlled, or electronically controlled by the user through a manually prepared program, so that the user may develop a repeatable pattern of physical stimulus which is pleasing to the particular user.

Figure 1:
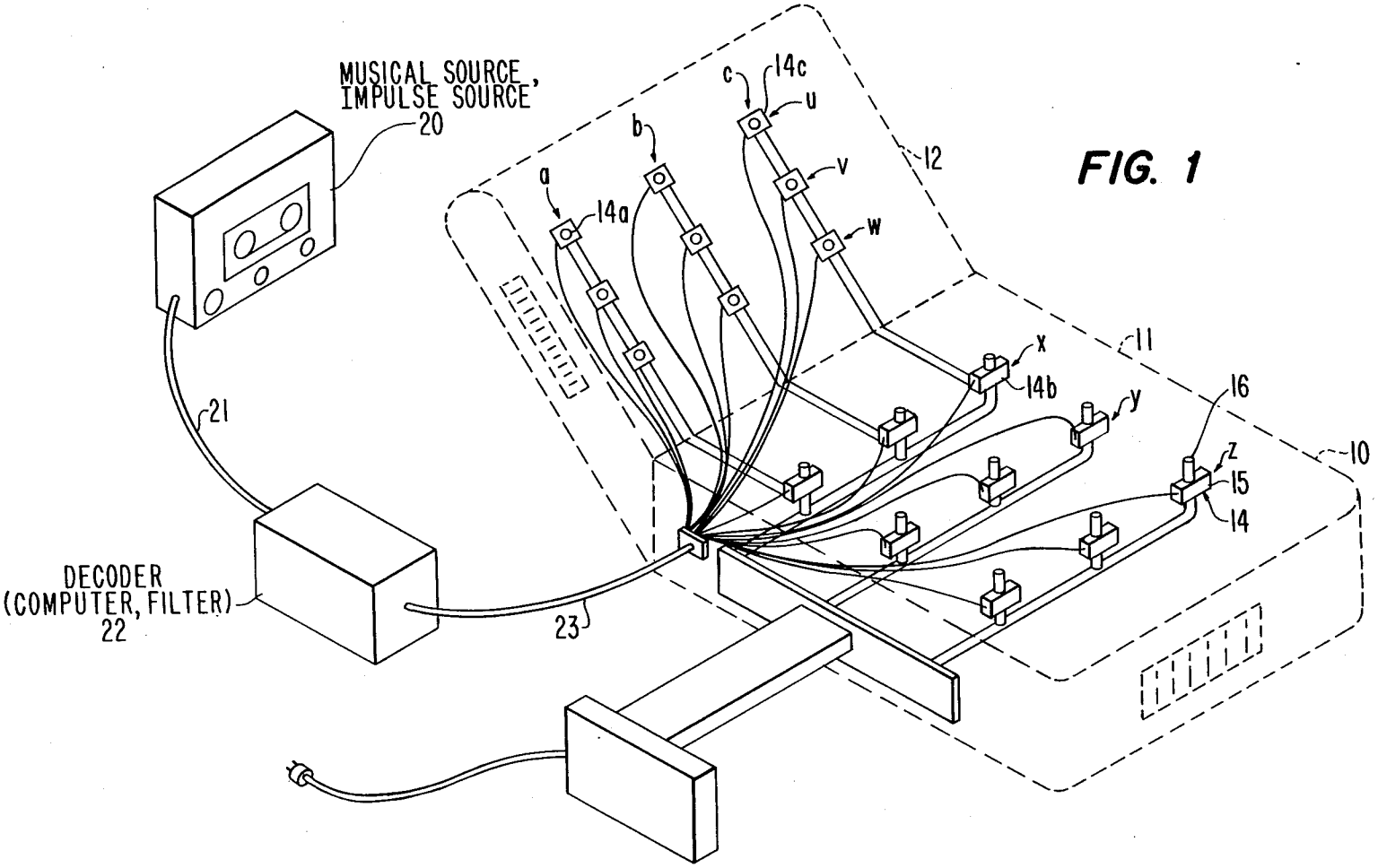

In still another alternative embodiment, such a device may be used to deliver an exercise prescription to a patient for physical therapy. That exercise prescription may be directed to a particular portion of the body which is normally stimulated manually by a massage. Other embodiments are disclosed in the specification, as are methods of using such devices.

These and other features of the invention will become apparent from a written description of the invention which follows, taken in conjunction with the accompanying drawings.

BRIEF DESCRIPTION OF THE DRAWINGS

Figure 2:
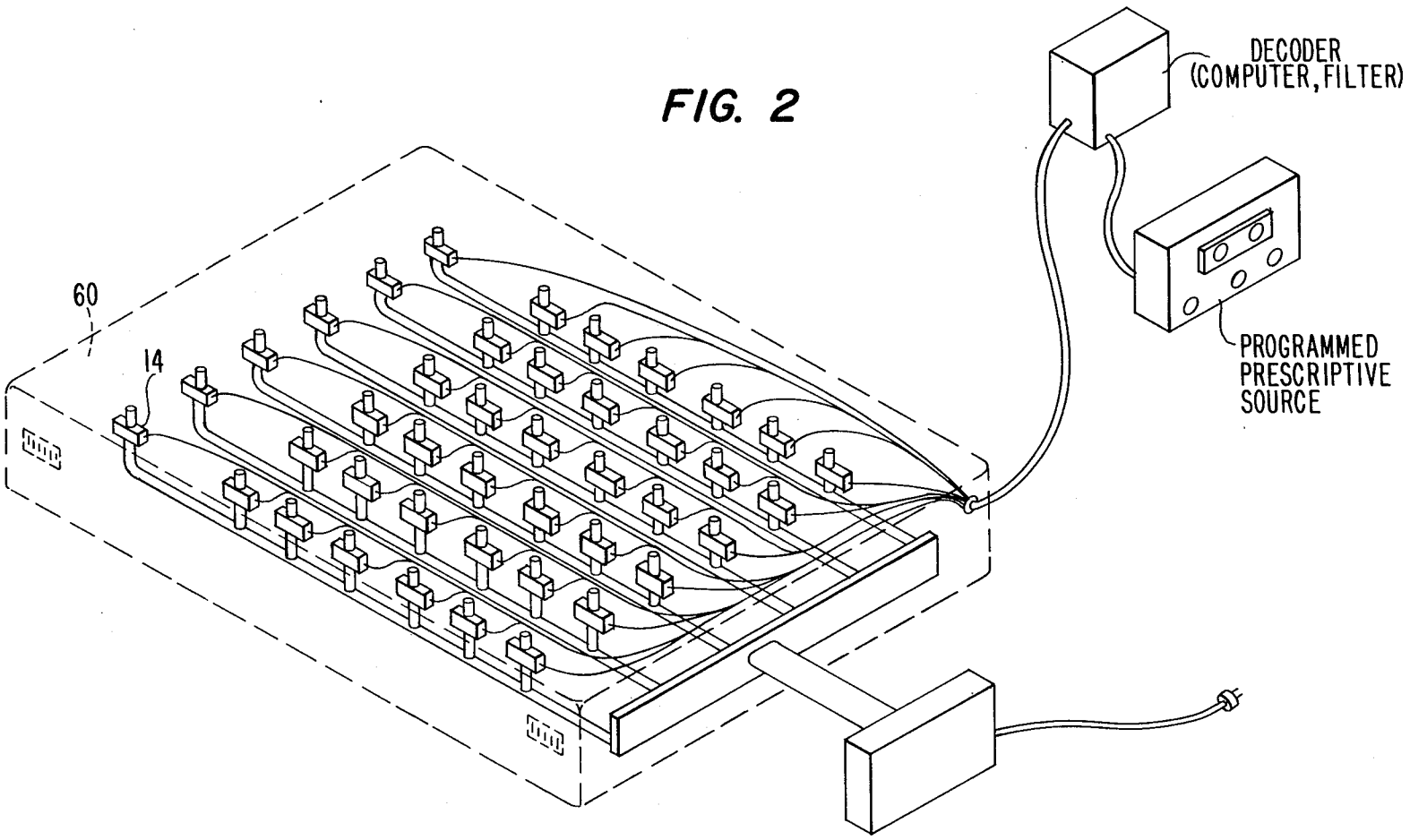
Figure 3:
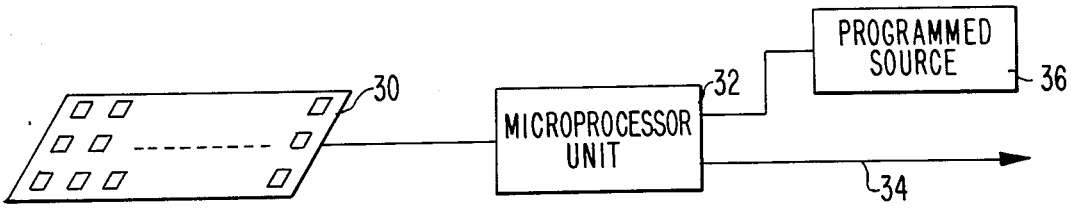
Figure 4:
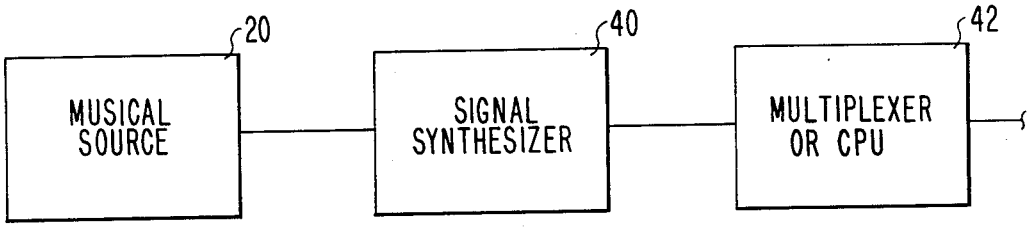
Figure 5:
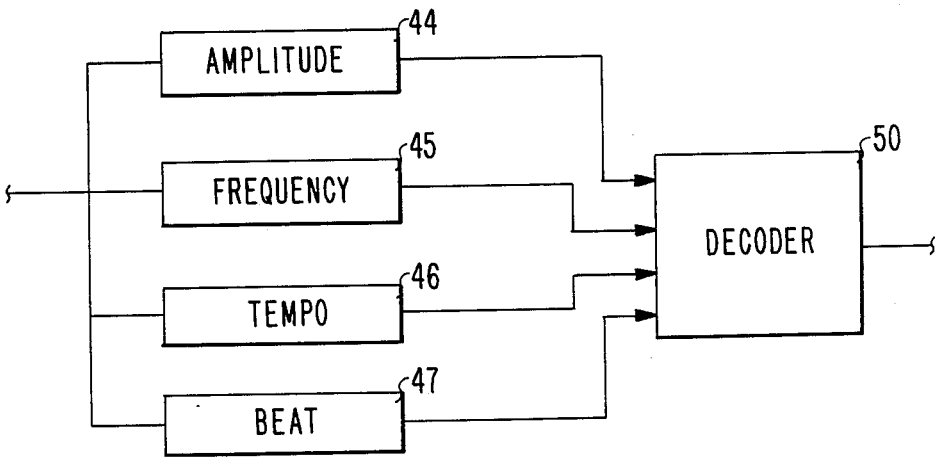
Figure 6:
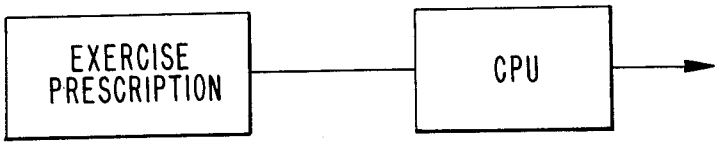

In the drawings:

FIG. 1 is a conceptual diagram of the apparatus according to the invention showing a plurality of switches in a spaced array in a sofa which are driven by a musical source through a decoder in circuit with the musical source;

FIG. 2 is a view similar to FIG. 1 showing a bed incorporating a plurality of switches for providing exercise therapy according to a preprogrammed exercise prescription;

FIG. 3 is a block diagram of an alternative source of signals for the devices of FIGS. 1 and 2 which are manually initiated through a keyboard;

FIG. 4 is a block diagram in greater detail of a representative input portion for the embodiment of FIG. 1;

FIG. 5 is a block diagram showing the output characteristics of the signal synthesizer; and FIG. 6 shows an input source for the embodiment of FIG. 2.

DETAILED DESCRIPTION OF THE PREFERRED EMBODIMENT

In FIG. 1, an article 10 for implementing the features of the invention is shown in the form of a sofa having a seat portion 11 and a back portion 12. A plurality of switches 14 are provided on both portions 11, 12 of the article 10 in a spaced array to define particular addresses for each switch for selective actuation according to the programmed source. In the embodiment shown, columns a, b, and c are representatively shown, having rows u, v, . . . z. Thus, each switch 14 has an address recognizable by a microprocessor such as the switch 14*a* located at the address a, u, and switch 14*b* having an address c, x. Such addresses are conveniently reached by signals controlled by a multiplexer, microprocessor, or other switching arrays.

Each of the switches 14 has a switch portion 15 and an actuated, extensible portion 16 operable so that when the switch receives an electrical signal, the portion 16 extends a predetermined, and, if desired, controllable distance. The switches 14 are each located in a portion of the article 10 near a surface thereof so that when actuated, the portion 16 extends sufficiently to make comfortable contact with the body of the user seated in a reclining position on the article 10. A fabric covering which is sufficiently resilient to permit the transmission of motion of the actuator 16 may cover the article 10. The article 10 may take a number of forms, of which the sofa 10 is representative.

Preferably, each switch 14 is a pulsating switch which may be digitally controlled by digital signals to represent an on and off state. Thus, a source of musical signals 20 provided on a cable 21 to a microprocessor-based decoder 22 which provides an addressed digital output on a cable 23 to pre-selected switches 14 according to a preprogrammed sequence. While the switching characteristics may vary in accordance with a number of musical features which may be derived from the musical source 20, in a simple preferred embodiment, pre-selected switches 14 are actuated according to the tempo of the music of the source 20. Thus, for example, all, or selected ones of the switches 14 in the array a . . . , x . . . , can be simultaneously actuated upon the delivery of each note from the musical source 20. Then, the sensation experienced by the user bears a direct relationship with the tempo of the music since the user will feel an impulse each time a note is struck. Slower music will thus provide fewer impulses, while faster music will provide faster impulses.

As a second example of the programming available for tempo-responsive stimulation, pre-selected ones of the switches in the array a . . . , x . . . , may be actuated. Thus, for example, each of the switches in row u for columns a, b and c can be actuated for a given note, followed by actuation of each of the switches in row v, columns a, b and c, and so forth. The possibilities for converting analogue signals from the source 20 to digital signals for controlling the switches 14 are virtually endless in that the decoder 22, which comprises a computer or microprocessor, may be programmed to control the switch array a . . . , u . . . , in any desired, responsive, programmed pattern $a_n$ . . . , $u_n$ . . . , to the music, based on the content of the music.

In an alternative, the switches 14 may include an extensible member 16 whose extension is proportional to the amplitude of the signal applied to the switch. Thus, the output signal from the decoder 22 can be provided in a way in which the respective switches in the array are selectively actuated to extend a distance which is proportional to or related to the amplitude of the signal applied, and the amplitude of the signal thus applied may be selected in accordance with the amplitude of the signal of the music, for example. Such an operation may be controlled through either analogue or digital techniques. Then, louder music may provide more intense stimulation compared to softer music, for example, or lower frequency signals may provide a more intense stimulation as compared to higher frequency signals by the use of a filter in the decoder 22. Thus, it can be seen that the intensity of vibration, if desired, may be provided in a way which bears one of a number of possible relationships to a characteristic of the musical signal from the source 20.

In accordance with the block diagram shown in FIG. 3, an alternative source of input signals may be derived from a keyboard 30 in circuit with a microprocessor unit 32 for directly providing addressed signals to the switches 14 in the array of FIG. 1 on a cable 34, or for individually programming a sequence which is of interest and comfortable to the user as represented by the block diagram 36. The keyboard 30 may also be contained in an array of switches in a touch-sensitive screen, such as is known to the art. When manually provided on the cable 34, the electrical signals represent a pattern and sequence of actuation which are keyed, in a multiplex fashion, to actuate selected ones of the switches 14 in the array a . . . , u . . . , in FIG. 1 according to the desires of the user. The user may thus retain the keyboard 30 in his lap and select the pattern which is comfortable to him at that moment to provide a varying self-massage.

When the user programs his own signals, such as to a cassette tape, or computer disk, comprising for example the programmed source 36, he may then prepare a sequence comfortable to him, such as at the end of a work day, on a one-time basis and simply play his source 36 to repeat that sequence which the user has individually developed. In this way, the tactile stimulation acts as a massage stimulation according to the wishes and needs of the user.

Returning to FIG. 1, and referring to FIGS. 4 and 5, alternative examples of characteristics of the musical source are indicated for use in the embodiment of FIG. 1. Thus, the musical source 20 provides output signals to a signal synthesizer 40 in circuit with a multiplexer 42 to provide output signals according to a planned sequence to the array of switches 14 in the device 10 in FIG. 1. The signal synthesizer 40, as shown in FIG. 4, may provide output signals representative of preselected characteristics of the source 20 including amplitude, frequency, tempo, or beat. Thus, FIG. 5 shows in block form a plurality of circuits 44, 45, 46, and 47 for respectively extracting signals from the analogue or digital musical source to provide digital output signals to a decoder 50 for representing that particular selected musical characteristic. In the embodiment of FIG. 1, discussion centered on actuating the switches 14 in accordance with the frequency with the tempo 46 of the signal. Alternatively, the amplitude 44 of the signal can be used in an amplitude signal selected for actuating the switches only when the signals reach a certain amplitude determined by a circuit. When so applied, the user feels no sensation during soft quiet music, but is stimulated during more intense passages. Alternatively, as was discussed in connection with FIG. 1, the amplitude selector 44 in the synthesizer 40 may vary the intensity of the switches in accordance with amplitude by using analogue techniques digitized in a decoder 50 in a manner known to the art. Beat may also be determined in a beat detector 47 to provide a beat-sensitive control signal to the switches 14. Other characteristics of the music may also be used.

As another example of implementation of this device, the electronics of musical synthesizers could be used as input sources for the multiplexer 42 and, depending upon the capabilities of the synthesizer, the digitally-synthesized signals available therefrom representing particularized musical characteristics can be provided according to a predetermined program to actuate the switches in a predetermined manner. Thus, in a more sophisticated example of an embodiment of the invention, such characteristics as attack time, decay time, timbre, and the like, from the synthesizer, may be used to control the sequence of tactile stimulation.

The foregoing embodiments may also create a class of music wherein artists create music specifically intended for application to this device so that tone may diminish in significance compared to touch. By using multiple function values and switches located in the device 10, the switches could be caused to flutter, pulsate, vibrate, rotate, or move from side-to-side, thus creating a touching, moving, sensation allowing the artist for the first time to "play" his music on a user's body. With such preprogrammed control as has been described, the artist may use a variety of movements of the switches to create patterns of movement and sound for a total new effect. Thus, the apparatus of the invention has interest from an entertainment standpoint in a new manner.

Another application for the apparatus of FIG. 1 is in the use of providing entertainment for bedridden patients, such as in a hospital environment. Such entertainment characteristics, when associated with such, may also be used to provide massage and therapy during convalescence.

The apparatus of FIG. 2 is similar to concept to that of FIGS. 1, 4 and 5, and any of the input sources or characteristics as shown in FIGS. 3–5 could be used in place of the input source for FIG. 2. For equivalents, the array of switches 14 shown in FIG. 2 is located in a bed, and the operation of the switches according to the programmed source is substantially like that in FIG. 1. In this embodiment, however, the use of a preprogrammed exercise prescription is specifically disclosed so that the source of signals to be decoded for selective actuation of the switches 14 in the array a . . . , u . . . , in FIG. 2 depends upon the desires and needs of the therapist for exercising the individual using the bed 60, or a specialized localized device for a knee, for example, and having switches 14 therein.

The microprocessor-based multiplex control of a plurality of switches in a spaced array for tactilely stimulating a human body may also find application in a number of other embodiments. For example, such a device could be used as a safety device in an automobile or airplane to periodically activate the driver or pilot merely to heighten attention during periods otherwise likely to develop drowziness or inattention. Alternatively, such signals could be provided to the driver or pilot or a reminder to change direction when coordinated with an input source which is related to map coordinates. Still further, such a device may be used for training by using a preprogrammed source to stimulate instruction.

It will clearly be understood by those skilled in the art that the foregoing description has been made in terms of the preferred embodiments and various changes and modifications may be made without departing from the scope of the present invention which is to be defined by the appended claims.

What is claimed is:

1. An apparatus for providing tactile stimulation of a body, comprising:

a source of signals having a predetermined electrical characteristic;

means for decoding said electrical signals to produce a programmed sequence of operative output signals;

an article structurally adapted for receiving at least a portion of a body of a user in contact therewith, said article including a plurality of switches in a spaced array, each of said switches having an extendable portion which, when actuated, extends and moves an area of said article against a portion of said body of said user;

said switches being connected to said decoding means to receive said operative output signals to be actuated thereby according to said programmed sequence, whereupon said body is tactilely stimulated according to said sequence.

2. The apparatus as set forth in claim 1, wherein said source of electrical signals includes signals representative of a prescriptive course of exercise therapy, whereby pre-selected switches are actuated in a preselected pattern for a particular area of the body at a particular time, whereby said user is therapeutically massaged.

3. The apparatus as set forth in claim 1, wherein said article is a bed, said switches being located near a surface of said bed to provide tactile stimulation of a body in said bed.

4. The apparatus as set forth in claim 3, wherein said article is a sofa having a seat portion and a back portion, some of said switches being located near a surface of each of said portions.

5. The apparatus as set forth in claim 1, wherein said source of signals is a keyboard and said decoding means is a microprocessor unit, said keyboard cooperating with said microprocessor unit for directly providing said operative electrical output signals to said switches to stimulate said user in response to a manual input.

6. The apparatus as set forth in claim 5, further including means for recording said manually produced signals for reproduction from said source.

7. The apparatus as set forth in claim 1, wherein said source of signals is a source of analogue signals, and said decoder means includes means for converting said analogue signals into digital signals.

8. The apparatus as set forth in claim 2, wherein said source of analogue signals is a musical source for providing musicial signals.

9. The apparatus as set forth in claim 8, wherein said output signals are representative of a particular, preselected, characteristic of said musical signals so that said actuation of said switches in said array tactilely simulates said music.

10. The apparatus as set forth in claim 9, wherein said pre-selected characteristic is tempo, so that the rate of actuation of said switches according to said programmed sequence corresponds to the tempo of said music.

11. The apparatus as set forth in claim 9, wherein said decoder means includes filter means so that said operative output signals are proportional to a selected frequency band of said signals, the actuation of said switching means being determined by the signals so selected according to said programmed sequence.

12. The apparatus as set forth in claim 9, wherein said extendable portions, when actuated, move a distance proportional to the amplitude of the signal provided thereto, so that louder music provides more intense stimulation.

13. The apparatus as set forth in claim 9, wherein said decoder means includes means for sensing the beat of said music, and said output signals are representative of said beat.

14. The apparatus as set forth in claim 9, wherein said operative output signals are a function of the amplitude of said musical signals, the frequency of actuation of said switches in said array being a function of said amplitude.

15. The apparatus as set forth in claim 14, wherein said extendable portions, when actuated, move a distance proportional to the amplitude of the signal provided thereto, so that louder music provides more intense stimulation.

16. The apparatus as set forth in claim 15, wherein said decoder means includes means for sensing the beat of said music, and said output signals are representative of said beat.

17. A method of tactilely stimulating at least a portion of a body of a user, comprising the steps of:

providing a source of electrical signals having a predetermined electrical characteristic;

decoding said signals to provide operative electrical output signals having a predetermined programmed sequence;

providing an article having, in a spaced array, a plurality of switches each including a portion extendable upon actuation to move an area of the article;

positioning at least a portion of the body in contact with at least one of the areas movable by the extendable portions; and actuating said switches in said spaced array to extend the extendable portions in accordance with said operative output signals, and thereby to tactilely stimulate at least a portion of said body of said user.

18. The method as set forth in claim 17, wherein the step of providing includes the step of providing a musical source of said signals, whereby said body is stimulated according to a characteristic of said music.

19. The method as set forth in claim 17, wherein the step of providing includes the step of providing a programmed source of exercise signals, whereby said body is stimulated according to an exercise prescription.

* * * * *